US008403639B2

(12) United States Patent
Vedsted et al.

(10) Patent No.: US 8,403,639 B2
(45) Date of Patent: Mar. 26, 2013

(54) PUMP

(75) Inventors: Per Frost Vedsted, Bjerringbro (DK); Oluf Eriksen, Viborg (DK)

(73) Assignee: Grundfos Management a/s, Bjerringbro (DK)

( * ) Notice: Subject to any disclaimer, the term of this patent is extended or adjusted under 35 U.S.C. 154(b) by 916 days.

(21) Appl. No.: 12/500,634

(22) Filed: Jul. 10, 2009

(65) Prior Publication Data

US 2010/0008768 A1 Jan. 14, 2010

(30) Foreign Application Priority Data

Jul. 10, 2008 (EP) ..... 08012460

(51) Int. Cl.
*F03B 11/00* (2006.01)

(52) U.S. Cl. ..... 415/208.2; 416/186 R

(58) Field of Classification Search ..... 415/200, 415/209.1, 208.2, 208.4, 208.5, 199.1; 416/186 R, 416/229 R See application file for complete search history.

(56) References Cited

U.S. PATENT DOCUMENTS

| | | | |
|---|---|---|---|
| 3,979,549 | A | 9/1976 | Wilkinson |
| 4,776,760 | A | 10/1988 | Grisz |
| 5,219,461 | A | 6/1993 | Hyll et al. |
| 5,344,515 | A | 9/1994 | Chenock, Jr. |

FOREIGN PATENT DOCUMENTS

| | | | |
|---|---|---|---|
| CN | 2345748 | Y | 10/1999 |
| EP | 0 376 225 | A2 | 7/1990 |

OTHER PUBLICATIONS

Office Action issued May 30, 2011 in CN Application No. 200910140251.9.

*Primary Examiner* — Dwayne J White

(74) *Attorney, Agent, or Firm* — Panitch Schwarze Belisario & Nadel LLP

(57) ABSTRACT

A pump, in particular a centrifugal pump, includes at least one flow-leading part with an at least regional surface layer (50) of an elastomer. The flow-leading part with the surface layer (50) is formed as a multi-component injection molded part, with a base structure (55) made of plastic as a first component, and with the elastomer as a second component.

16 Claims, 6 Drawing Sheets

100
125
195
125
110
155
115
10
145
105
120
175
140

160
170
165
160
120
A
195
115
A
155

PUMP

BACKGROUND OF THE INVENTION

The invention relates to a pump and, in particular, to a centrifugal pump. The life duration of pumps, amongst other things, depends on the nature of the fluid to be delivered. For example, foreign matter in the fluid, such as sand-like particles, leads to a wearing of parts of the pump.

BRIEF SUMMARY OF THE INVENTION

It is therefore an object of the present invention to provide a pump, which may also be operated in a reliable manner with foreign matter in the fluid to be delivered and which has a high durability. This objective is achieved by a pump with the features specified in the independent claim. Advantageous designs are specified in the dependent claims, the subsequent description and the drawings.

With regard to the pump according to the invention, it is preferably a centrifugal pump. The pump comprises at least one part leading the flow, with a surface layer of an elastomer, which is deposited at least in regions. This flow-leading part with the surface layer is designed as a multi-component injection molded part. This multi-component injection molded part has a base structure of plastic, which forms a first component. The elastomer of the surface layer forms a second component, which is integrally injected onto the base structure, or with which the base structure is peripherally injected at least in regions. The base structure gives the part its basic shape and mechanical strength. The surface layer of the elastomer has a large wear resistance, even when subjected to an on-flow by particles, and thus increases the durability of the at least one flow-leading part. The flow-leading part may be manufactured in a simple and inexpensive manner due to the manufacture of the flow-leading part together with the surface layer as a multi-component injection molded part, since one may make do without a separate manufacturing step for coating the flow-leading part with the elastomer.

Moreover, the surface layer is thus connected to the base structure in a particularly firm and permanent manner. A further advantage lies in the fact that with multi-component injection molding, the surface layer may be limited in a particularly simple manner to part regions or sections of the surface of the two components. Preferably, the multi-component injection molded part is a two-component injection molded part, i.e. two plastic components are injected with one another, specifically the plastic for the base structure, and the elastomer as a surface layer.

Further, preferably, the elastomer is a synthetic rubber and, in particular, silicone rubber. Surface layers of silicone rubber have been found to be advantageously particularly resistant with regard to the on-flow, in particular with sand-containing fluids.

Moreover, the base structure of the flow-leading part is preferably of a plastic-composite material, in particular of fiber-reinforced plastic, as a first component. Such a material permits a high stiffness and robustness with a low constructional weight. In this manner, the first component ensures a particularly large stability of the flow-leading part, whilst the elastic second component provides for a good protection of the surface of the second component.

Preferably, the at least one flow-leading part of the pump is an impeller. In particular, the impeller surface is subjected to a large load due to the on-flow of the delivered fluid on operation of the pump. Thus the flow is deflected in the impeller, wherein particles contained in the fluid greatly load the flow-leading surfaces. Preferably, therefore, the blades of the impellers are covered with the surface layer of an elastomer. These are subjected to a particularly intensive on-flow by particles. This surface layer of the elastomer here significantly increases the durability of the flow-leading part.

Further, preferably, the flow-leading part is a diffuser. Similarly to the surface of the impeller, the surface of the diffuser is also subjected to a large loading due to the on-flow, since the flow direction of the fluid to be delivered is changed in the passages of the diffuser. Here, the blades of the diffuser, or the inner surface of the passages, are loaded particularly due to the on-flow by the particles. For this reason, at least these are provided with the surface layer of the elastomer.

In a further preferred design, the flow-leading part is a sealing element. Preferably, this sealing element is applied for leading the flow between a diffuser and an impeller. This sealing element too is typically subjected to a high loading by way of the on-flow of particles at its surfaces serving for leading the flow. Preferably, these surfaces too are coated with the elastomer. Further, preferably, with regard to this sealing element, it is a gap ring or a guide ring.

According to a further preferred embodiment, the flow-leading part is a diffuser, which comprises at least one radially outwardly projecting projection or ring, which is designed of metal at least in sections. Such a projection or ring serves for clamping the diffuser between two tubular housing sections. Thus, the diffuser may be fixed in the axial direction of the pump, between the housing sections. The diffuser may be simply arranged in the pump in this manner. No additional assembly steps or fastening means for fixing the diffuser are necessary. The at least sectioned design of the projection or ring of metal gives the projection or ring great strength and resistance capability with respect to pressure forces acting on the ring or projection from the housing sections. This permits one to make do without special bearing surfaces at the axial ends of the housing parts for distributing the clamping forces acting on the diffuser. On account of the at least partially metallic design of the projection or ring to be clamped, high compression loads that occur on small bearing surfaces may be absorbed. Preferably, non-rusting steel is applied as a metal for the projection or ring. In particular, with pumps delivering water, the durability of the diffuser and also the life duration of the pump may be increased.

Preferably, the ring or projection of metal is cast into the first and/or second component of plastic. Thereby, it is particularly preferable to cast metallic elements into the first component which forms the base structure, since this is preferably designed in a stiff manner and thus permits a precise positioning of the metallic elements and force transmission. It is possible to design the complete projections or the complete radially projecting ring of metal, wherein the radially inner end of the ring or projection is cast into the remaining parts of the diffuser or its base structure. Moreover, it is also conceivable to partially cast the projections or a radially projecting ring of plastic, together with the remaining base structure of the diffuser, and to only cast individual metal elements into this projection or ring, preferably distributed uniformly over the periphery. The force transmission between the adjacent housing parts is then effected via these cast-in metallic elements, so that the remaining plastic structure of the projections or of the ring is not loaded with compression/pressure forces. The ring and projection do not need to be cast with the remaining parts of the diffuser in one working procedure. Rather, here it is also possible to cast or inject these components in a further step.

However, it may also be useful for the flow-leading part not to form a diffuser or an impeller as a whole, as described above. In further embodiments, it may be desirable for the at least one flow-leading part to form at least one component of an impeller or diffuser, which are manufactured from at least two components. Thus, with impellers or diffusers designed in a multi-part manner, one may also realize complex geometries in a simple manner. Thus, an impeller manufactured of at least two components or a diffuser manufactured of at least two components, may comprise one or more components, whose surface is not loaded or only to a small extent by the on-flow of the fluid to be delivered. In such cases, it may be useful to only design the components loaded by the on-flow with the surface layer of the elastomer. Preferably, it is thereby the case of those components which change the flow direction or the flow speed of the fluid, in particular around the parts of the diffuser and impeller which are designed with passages.

Particularly preferably, the at least one flow-leading part comprises flow-leading blades which are preferably provided with the surface layer of the elastomer. With the two-part design of the flow-leading part, it is in particular possible to only manufacture one of the two parts in two-component injection molding and to form the desired surface layers of elastomer there. The second component may then be designed as a normal plastic injection molded part. Subsequently, both parts may be welded to one another. It is thus possible, for example, with a diffuser or an impeller, to design a first cover plate together with the blades with two-component injection molding and in particular to attach a surface layer of elastomer on the blades surfaces. The second cover plate may then be manufactured as a single-component injection molded part and be connected to the first components for example by way of ultrasound welding.

In a preferred design, the first component of the flow-leading part comprises at least one recess or a projection, with which the elastomer is engaged. In this manner, the elastomer is connected to the second component in a particularly permanent and firm manner. On the one hand the contact surface between the elastomer and the second component is increased by the recess or the projections and thus its material fit connection along this contact surface is strengthened. On the other hand, the connection of the elastomer to the second component by way of the meshing is also supported with a positive fit. The recesses and projections may for example also be designed as a profiled surface of the first component, with which the elastomer is engaged.

Preferably, the first component of the flow-leading part comprises at least one passage connecting the two surfaces, which is penetrated by the elastomer. Should roughly two surfaces of the flow-leading part, which are distant to one another, be coated with the elastomer, then on injection molding, the elastomer may get through the passage from one surface to the other. Thus flow paths for the second component, i.e. the elastomer, may be kept short in the tool. Moreover the elastomer may be thus meshed with the first component and particularly firm connection between both components may be created.

In a preferred design, with regard to the pump, it is a multi-stage pump. With a multi-stage pump, there are several flow-leading parts such as diffuser, sealing element and impeller, which are subjected to wear by way of abrasion. The design of the flow-leading parts of the pump, in particular of the sealing element, the impeller and the diffuser, which has been described above, therefore permits a reliable operation, even with a pump constructed of several stages.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

The invention is hereinafter explained in more detail by way of an embodiment example represented in the drawings. There are shown in the drawings.

DETAILED DESCRIPTION OF THE INVENTION

With regard to the inventive pump of this embodiment example, it is preferably a centrifugal pump. The pump thereby comprises several flow-leading parts as described hereinafter.

Figure 6:
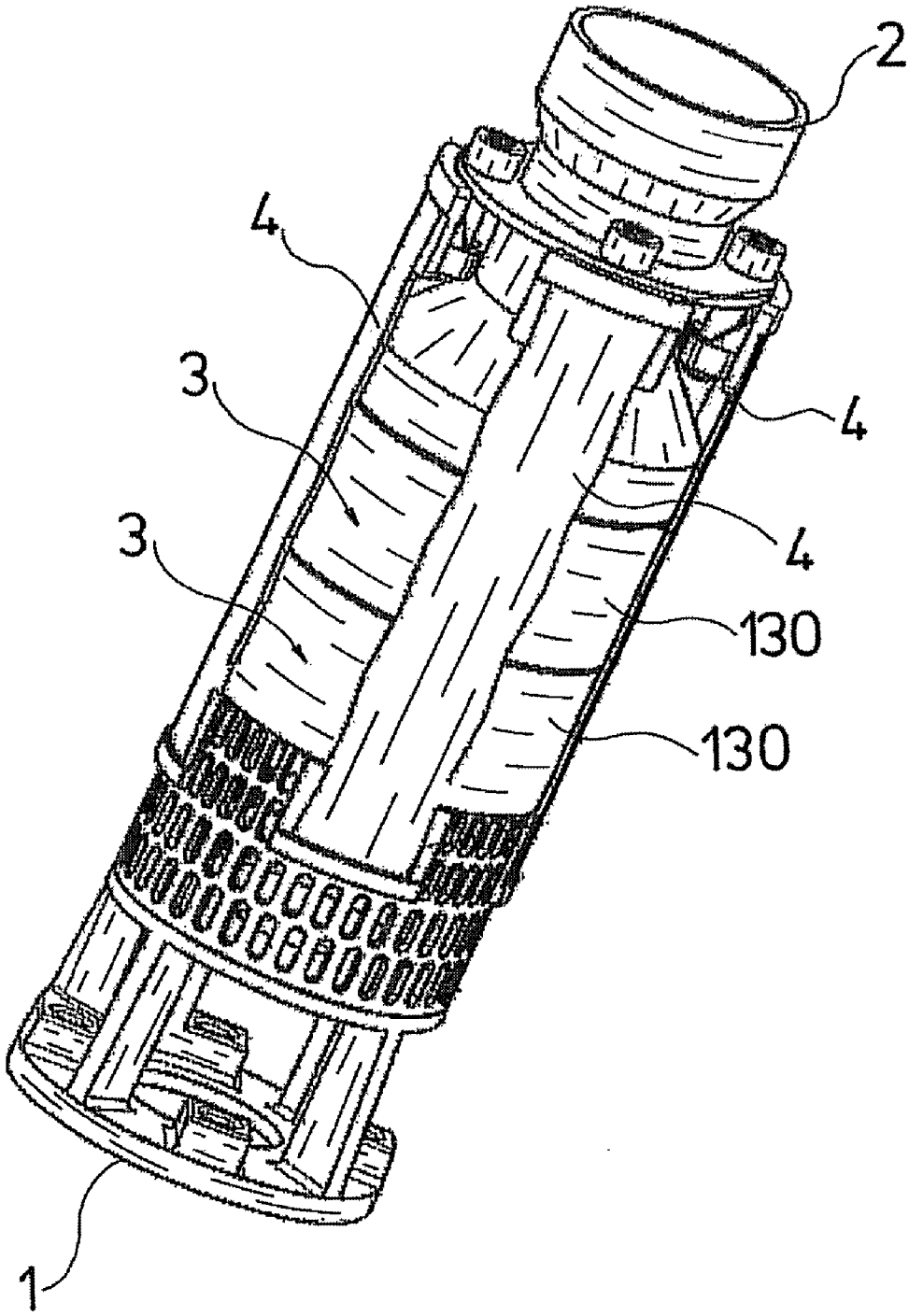
FIG. 6 is a perspective entire view of the pump according to the invention.

A schematic entire view of the pump according to the invention is shown in FIG. 6. Here, it is a two-stage centrifugal pump. The pump at one axial end comprises a connection piece 1 and at the opposite axial end comprises a pump head 2. The connection piece 1 serves for the connection to a motor which is not shown. The pump head 2 comprises the outlet of the pump. Two pump stages 3 are arranged between the pump head 1 and the outlet 2. The pump stages 3 are braced between the intermediate piece 1 and the pump head 2 by way of tightening straps 4.

Figure 1A:
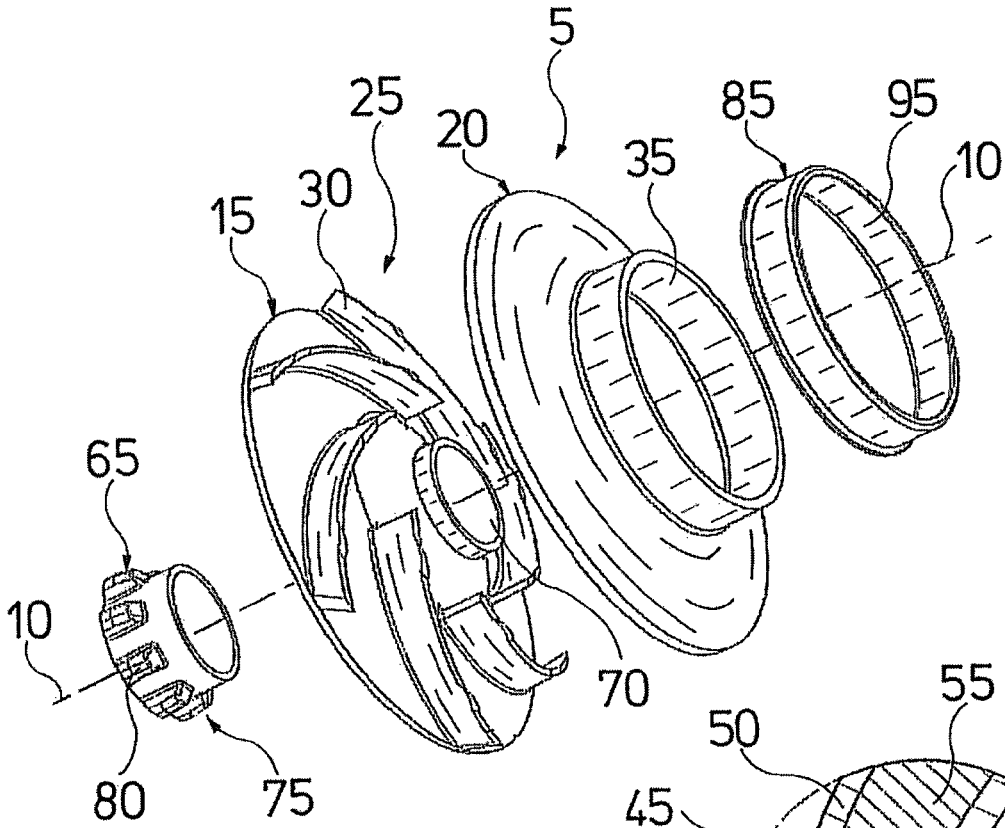
FIG. 1A is an impeller of a pump according to the invention, with a flow-leading component, in a perspective exploded view.
Figure 1B:
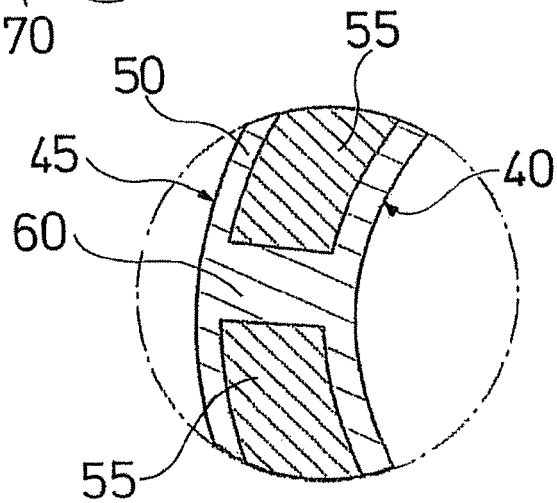
FIG. 1B is a detail of the flow-leading component of the impeller according to FIG. 1A, in a sectioned view.

A flow-leading part of the pump is a component of an impeller 5 constructed of several parts. The construction of this impeller 5 is represented in FIG. 1A. The individual components of the impeller 5 thereby are all arranged coaxially to the rotation axis 10 of the centrifugal pump. The impeller 5, as important components, comprises two circular cover plates 15, 20. A first circular, essentially plane cover plate 15 thereby forms a flow-leading part of the pump in the context of this invention. This first cover plate 15 at its inner side 25 which faces the other cover plate, comprises blades 30 grouped around its centre. A second, likewise essentially plane cover plate 20 which comprises a suction port 35 for the fluid, is located opposite the side 25 of the first cover plate 15. Thereby, the side 25 of the first cover plate 15, which faces the inside of the impeller 5, and in particular the blades 30 which are arranged on it, are particularly greatly loaded by the on-flowing particles in the fluid to be pumped. The flow direction of the fluid to be delivered is deflected at the blades 30 from the axial into the radial direction, so that the blades 30 are subjected to a more intensive on-flow by the particles. In order to avoid a wearing of the blades 30 due to on-flowing particles, the surfaces 40, 45 of the blades 30 are provided with a surface layer 50 of elastomer, as shown in FIG. 1B. The base structure 55 of the blades 30 and the cover plate 15 is thereby formed of fiber-reinforced plastic.

The blades 30 with the cover plate 15 are designed in a rigid and stable manner by way of the base structure 55 of fiber-reinforced plastic. The surface layer 50 of the elastomer on the other hand has a large elasticity and provides a large wear resistance also with an on-flow by the particles in the fluid to be delivered. The first cover plate 15 is manufactured by way of two-component injection molding with the fiber-reinforced plastic as the first component, and with the elastomer as the second component. Thus, firstly, the base structure 55 may be cast as a first component and then the elastomer as a second component around the base structure 55. This may be effected in the same injection-molding machine, preferably in the same tool.

The detailed construction of a blade 30 of the first cover plate 15 is shown in an enlarged, schematic sectioned view in FIG. 1B. The blade 30 thereby is designed with a base structure 55 of fiber-reinforced plastic which comprises at least one passage 60. This passage 60 connects the two surfaces 40, 45 of the blades 30, which are distant to one another.

Firstly, the peripheral injection of the base structure 55 of the blades 30 with the elastomer during manufacture is significantly simplified by way of the passages 60. Thus the flow paths for the elastomer are kept short, since the elastomer does not need to flow around the outer edges of the blades 30 for coating the two surfaces 40, 45. Instead, the elastomer gets to the other side of the blades via an extremely short flow path in the form of the passage 60, by way of it penetrating the passage 60.

Moreover, the surface layer 50 may itself be kept extremely thin by way of the additional channels in the form of passages 60 for distributing the elastomer in the injection molding tool. For this reason, the surface layer 50 only demands a reduced material expense. On the other hand, the blade 30 has high shape stability, even with an increased on-flow of the fluid to be delivered, due to the only thin surface layer of the elastomer. The elastomer furthermore meshes in the passages 60 with the base structure 55 of the fiber-reinforced plastic. For this reason, the surface layer 50 is connected to the base structure 55 in a firm and permanent manner.

The second cover plate 20 is likewise formed of fiber-reinforced plastic and is joined together with the first cover plate 15 by way of ultrasound welding. In this manner, the complex geometry of the impeller 5 with its inner channels between the blades 30 may be cast without undercuts requiring cores.

Apart from this, the impeller 5 as a further component, comprises as hub 65, which is inserted into a central receiver 70 of the first cover plate 15, for the rotationally fixed connection to a drive shaft. The connection of the hub 65 to the impeller 5 is thereby effected via a toothed ring 75 with radially projecting teeth 80, which come into engagement with the base structure 55 of the first cover plate 15, in particular may be cast in.

The impeller 5 on the second cover plate comprises an outwardly directed sealing ring 85 which is pushed over the suction port 35 on the second cover plate 20, for the sealed contact of the impeller 5 with a diffuser. The sealing ring 85 is thereby designed as a metallic sleeve 85, for example, which fits with the suction port 35 and which forms a bearing surface for a seal designed on the diffuser.

A further flow-leading part of the pump, with several other components, forms a diffuser 100. This diffuser 100 is represented in the FIGS. 2A to 4. The diffuser 100 likewise comprises a first circular cover plate 105, which is designed in an essentially plane manner and also, with the diffuser 100, forms a flow-leading part of the pump in the context of the invention. This first cover plate 105 comprises blades 115 on its inner side 110. A bearing surface 125 projects in the axial direction over the whole periphery on the edge 120 of the cover plate 105. This bearing surface 125 serves for the bearing of the diffuser 100 on a coaxially orientated section 130 of the pump housing (FIG. 4). The section 130 of the pump housing forms the housing of a pump stage 3. In each case, an impeller 5 as well as a diffuser 100 is arranged in each pump stage 3. The diffuser 100 is arranged between the pump stage 3 and the pump head 2 for the second pump stage 3.

A second, essentially plane cover plate 135 lies opposite the inner side 110 of the first cover plate 105. It comprises an annular inlet 140 for the fluid to be delivered, which is distant to the center and peripherally surrounds the rotor axis 10. A fluid entering through the inlet 140 of the second cover plate 135 of the diffuser 100 is deflected in the radial direction at the first cover plate 105 and exits out of the diffuser 100 through the outlet 145 on the rear side 150 of the first cover plate 105. This outlet 145 is surrounded by an axially extending connection collar 155.

Also, with the shown diffuser 100, the first cover plate 105 and the blades 115 are particularly heavily loaded by the on-flowing particles. For this reasons, the blades 115 are provided with a surface layer of the elastomer similarly to the blades 30 of the impeller 5, for the protection from on-flowing articles. For this, the first cover plate 105 with the blade is likewise manufactured by way of two-component injection molding. Thereby, it has a base structure 60 of fiber-reinforced plastic as a first component, and a surface layer 165 of the elastomer as a second component, which covers the blades 115. A detail of one blade 115 is shown in section in FIG. 2B. Thereby, the base structure 160 of this blade 115 is provided with passages 170, as with the base structure of the blades 30 of the impeller 5, and these passages are penetrated by the elastomer. Moreover, the essentially plane inner surface 175 of the cover plate 135 is formed with a surface layer of the elastomer for the protection from on-flowing particles.

Figures 2A, 2B, 2C:
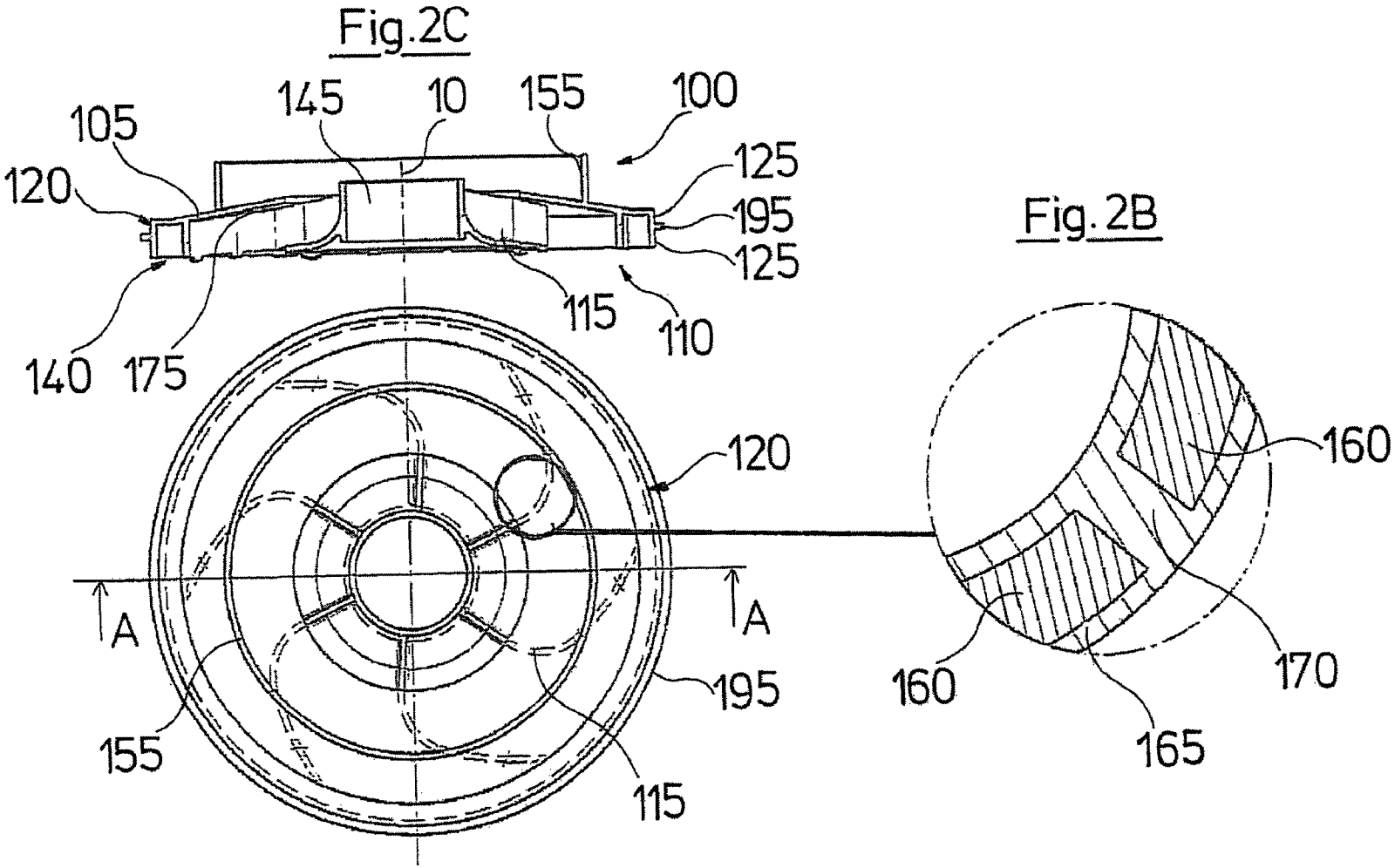
FIG. 2A is a flow-leading diffuser of the pump without the second cover disk, in a plan view.
FIG. 2B is a detail of the diffuser according to FIG. 2A, in a sectioned view.
FIG. 2C is the diffuser according to FIG. 2A, in a sectioned view.
Figure 3A:
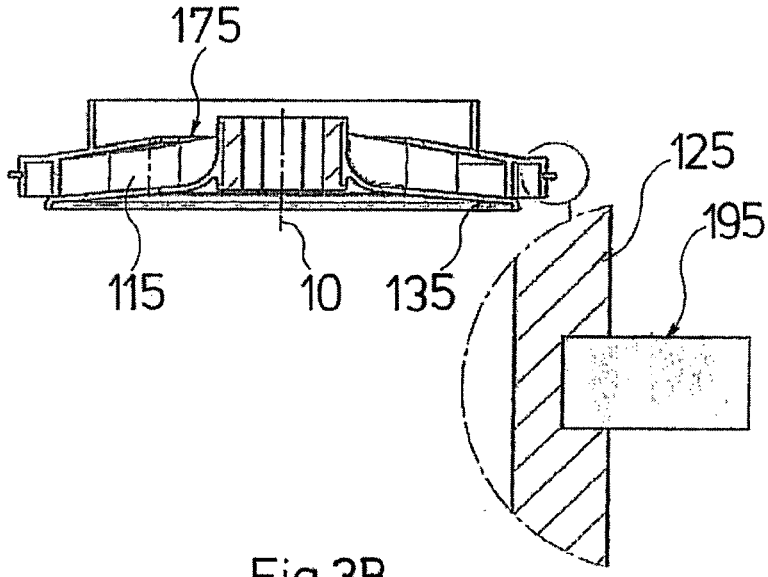
FIG. 3A is a diffuser according to FIG. 2A in a sectioned view, as well as a projection of the diffuser in a detail.
Figure 4:
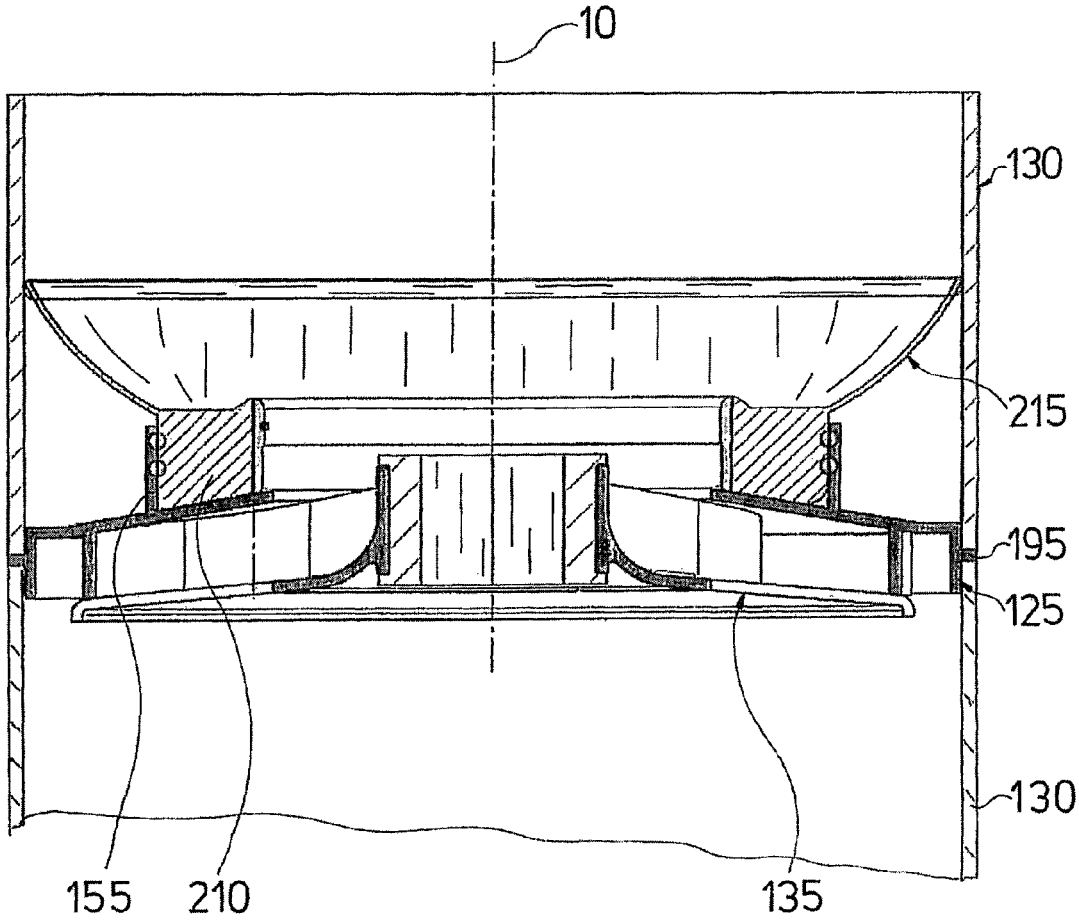
FIG. 4 is a flow-leading sealing element of the pump, as well as the diffuser according to FIG. 2A, in a sectioned view.

The diffuser 100, for the arrangement in the pump according to the invention, comprises a metallic projection 195 which projects from the bearing surface 125 and which extends outwards in the radial direction (FIG. 2A, 3A, 4).

Figure 3B:
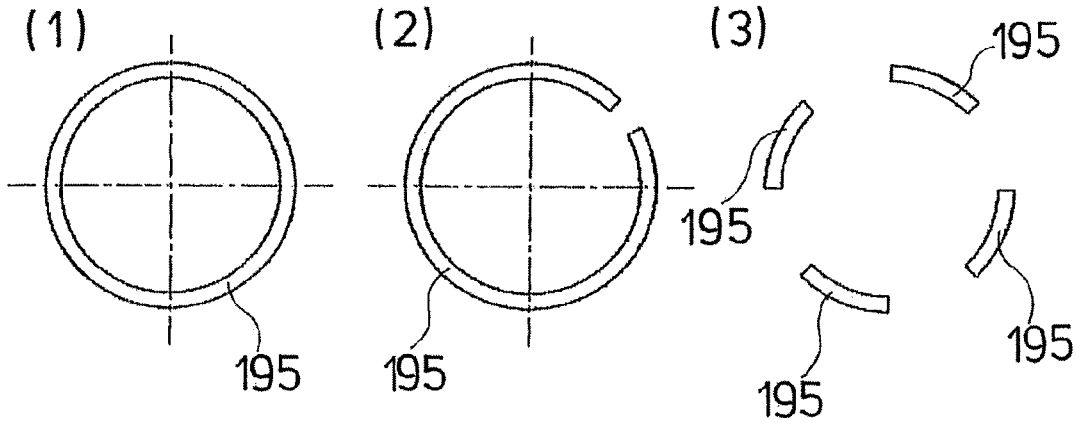
FIG. 3B is three embodiments of a projection of the diffuser, in an axial plan view.

The diffuser 100 is clamped on this projection 195 between two axially orientated tubular sections 130 of the pump housing (FIG. 4). In the embodiment example represented in FIG. 3A, the projection 195 is thereby designed as a metal ring, which completely peripherally surrounds the diffuser 100, and is cast into the base structure 160 of the first cover plate 105. The diffuser 100 may also be clamped on this metallic projection 195 with a high surface pressing without the projection 195 deforming. In FIG. 3B (1), the geometry of this annular projection 195 is shown in a first embodiment form in an axial plan view. This closed ring geometry is thereby particularly stable, since the projection 195 may thus be embedded into the diffuser 100 in a particularly firm manner. Moreover, the annular projection 195 fills the gap between the housing sections 130, so that a smooth outer surface of the pump arises.

Basically, it is, however, not necessary to design the projection 195 as a closed ring. Alternatively, it is possible to design the projection 195 as a ring segment. This is shown in a second embodiment in FIG. 3B (2). Here, the projection 195 is designed as a ring segment or as an open ring. Instead of a single ring segment, one may also cast a multitude of rings segments uniformly distributed around the periphery of the diffuser 100, into the fiber-reinforced plastic, which form the projections 155.

Figure 5:
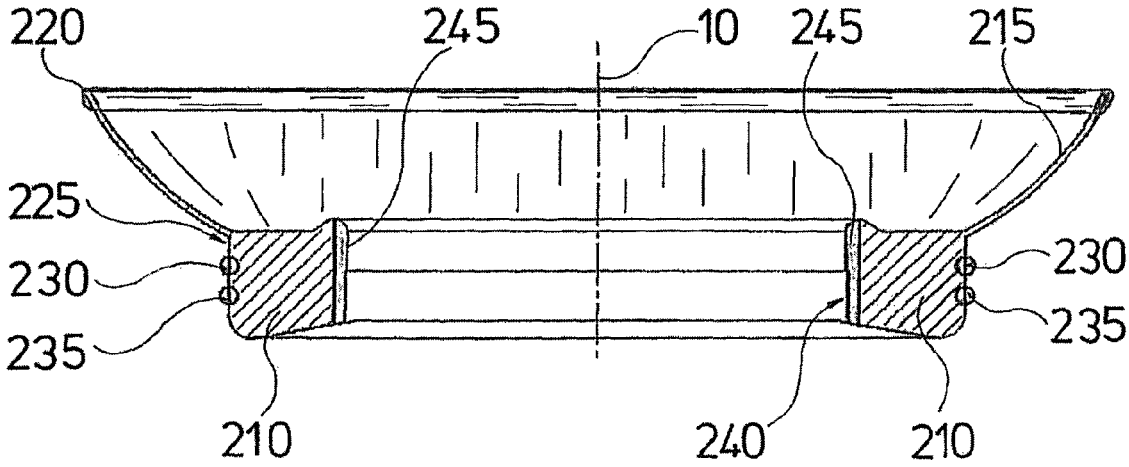
FIG. 5 is a sealing element according to FIG. 4 in a sectioned view.

A flow-leading part 210 of the pump according to the invention is shown in the form of a sealing element 210 in FIGS. 4 and 5. This sealing element thereby serves for leading the flow between the diffuser 100 and a subsequent impeller 5. The sealing element 210 essentially has the shape of a ring. The outer diameter of the sealing element 210 is thereby adapted such that it may be inserted into the connection collar 155 of the diffuser 100 in a sealing manner on the inner periphery. The inner diameter of the sealing element is designed fitting with the outer diameter of the sealing ring 85 of the impeller. At its pressure-side end, the sealing element 210 comprises a peripheral, radially and axially directed projection 215, which extends up to the section 130 of the housing which clamps the diffuser 100. Thereby, this projection 215, via a sealing lip 220 of elastomer arranged on the outer periphery, comes to bear with the section 130 of the housing. The pressure side of the diffuser 100 is opposite the surrounding housing section 130 by way of this. Moreover, the outer peripheral surface 225 of the sealing element 210 is provided with sealing rings 230, 235 of the elastomer, which bear with the inner peripheral surface of the connection collar 155 of the diffuser 100.

The inner peripheral surface 240 of the sealing element 210 is completely covered with a surface layer 245 of the polymer. In this manner, the inner peripheral surface 240 of the sealing element 210 on the one hand is protected from the on-flow by particles, and one the other hand the elastomer layer 245 also forms a sealing bearing surface for the bearing of the sealing ring 85 of the impeller 5. The sealing element too is thereby formed by way of two-component injection molding. Thereby, the elastomer layer 245, the sealing rings 230 and 235 as well as the sealing lip 220, form the second component, which is cast with the remaining part of the sealing element 210 as a first component.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A centrifugal pump comprising:

at least one flow-leading part (5, 100) including flow-leading blades having a surface layer (50, 165) of an elastomer, the flow-leading part (5, 100) having the surface layer (50, 165) designed as a multi-component injection molded part having a base structure (55, 160) of plastic as a first component and having the elastomer as a second component.

2. The centrifugal pump according to claim 1, wherein the elastomer is a synthetic rubber.

3. The centrifugal pump according to claim 2, wherein the elastomer is a silicone rubber.

4. The centrifugal pump according to claim 1, wherein the base structure (55, 160) of the flow-leading part is manufactured of a plastic-composite material.

5. The centrifugal pump according to claim 1, wherein the flow-leading part is an impeller (5).

6. The centrifugal pump according to claim 1, wherein the flow-leading part is a guide vane mechanism (100).

7. The centrifugal pump according to claim 1, wherein the flow-leading part is a guide vane mechanism (100) comprising an outwardly projecting projection (195) or ring formed at least partially of metal.

8. The centrifugal pump according to claim 7, wherein the projection (195) or ring is cast into one of the first component and the second component.

9. The centrifugal pump according to claim 1, wherein the flow-leading part forms at least one component (15, 30) of an impeller (5) manufactured of at least two components (15, 30, 20).

10. The centrifugal pump according to claim 1, wherein the flow-leading part forms at least one component (105, 115) of a guide vane mechanism (100) manufactured of at least two components (105, 115, 135).

11. The centrifugal pump according to claim 1, wherein the first component of the flow-leading part comprises at least one of a recess (60; 170) and a projection, the elastomer engaging the recess (60; 170) or the projection.

12. The centrifugal pump according to claim 1, wherein the first component comprises at least one passage (60, 170) connecting two surfaces through which the elastomer has penetrated.

13. A centrifugal pump comprising:

at least one flow-leading part (5, 100, 210) having a surface layer (50, 165, 245) of an elastomer, the surface layer covering at least a portion of the flow-leading part, wherein the flow-leading part (5, 100, 210) having the surface layer (50, 165, 245) is designed as a multi-component injection molded part having a base structure (55, 160) of plastic as a first component and having the elastomer as a second component, and wherein the flow-leading part comprises an impeller (5).

14. A centrifugal pump comprising:

at least one flow-leading part (5, 100, 210) having a surface layer (50, 165, 245) of an elastomer, the surface layer covering at least a portion of the flow-leading part, wherein the flow-leading part (5, 100, 210) having the surface layer (50, 165, 245) is designed as a multi-component injection molded part having a base structure (55, 160) of plastic as a first component and having the elastomer as a second component, and wherein the flow-leading part comprises a sealing element (210).

15. The centrifugal pump according to claim 14, wherein the sealing element (210) has at least a regional surface layer (245) of an elastomer.

16. The centrifugal pump according to claim 15, wherein the sealing element (210) is inserted between a guide vane mechanism (100) and an impeller (5).

* * * * *